US011220121B2

(12) United States Patent
Kinoshita

(10) Patent No.: US 11,220,121 B2
(45) Date of Patent: Jan. 11, 2022

(54) TRANSPORT DEVICE AND RECORDING DEVICE

(71) Applicant: SEIKO EPSON CORPORATION, Tokyo (JP)

(72) Inventor: Masaaki Kinoshita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 25 days.

(21) Appl. No.: 16/793,606

(22) Filed: Feb. 18, 2020

(65) Prior Publication Data

US 2020/0262220 A1 Aug. 20, 2020

(30) Foreign Application Priority Data

Feb. 20, 2019 (JP) ..... JP2019-028472

(51) Int. Cl.
*B41J 15/04* (2006.01)
*B41J 15/02* (2006.01)

(52) U.S. Cl.
CPC ..... *B41J 15/046* (2013.01); *B41J 15/02* (2013.01); *B41J 15/042* (2013.01)

(58) Field of Classification Search
CPC ..... B41J 15/046; B41J 15/02; B41J 15/042
See application file for complete search history.

(56) References Cited

U.S. PATENT DOCUMENTS

| | | | | |
|---|---|---|---|---|
| 6,519,441 | B1 | 2/2003 | Sugimura et al. | |
| 2010/0221054 | A1 | 9/2010 | Yamada et al. | |
| 2013/0342601 | A1* | 12/2013 | Yoshida | B41J 15/165 347/16 |
| 2015/0329310 | A1* | 11/2015 | Hayashi | B65H 23/1888 242/390.6 |
| 2016/0046137 | A1* | 2/2016 | Hatada | B65H 23/195 347/16 |
| 2017/0343934 | A1* | 11/2017 | Yamazoe | B65H 29/70 |
| 2019/0193975 | A1* | 6/2019 | Hamano | B65H 20/02 |

FOREIGN PATENT DOCUMENTS

| | | |
|---|---|---|
| JP | H08-26536 | 1/1996 |
| JP | H10-198096 | 7/1998 |
| JP | 2010-202306 | 9/2010 |
| JP | 2015-134655 | 7/2015 |
| JP | 2018-111610 | 7/2018 |

* cited by examiner

*Primary Examiner* — David H Banh
(74) *Attorney, Agent, or Firm* — Workman Nydegger

(57) ABSTRACT

A transport device includes a first driving roller configured to contact an outer circumferential surface of a roll body on which a medium is wound, and apply rotational torque to the roll body, a second driving roller configured to unwind the medium from the roll body, a first drive unit configured to drive the first driving roller, a second drive unit configured to drive the second driving roller, and a control unit configured to control the first drive unit and the second drive unit. The control unit controls the first drive unit, based on a magnitude of a load current flowing in the second drive unit.

6 Claims, 3 Drawing Sheets

TRANSPORT DEVICE AND RECORDING DEVICE

The present application is based on, and claims priority from JP Application Serial Number 2019-028472, filed Feb. 20, 2019, the disclosure of which is hereby incorporated by reference herein in its entirety.

BACKGROUND

1. Technical Field

The present disclosure relates to a transport device and a recording device.

2. Related Art

JP-A-2010-202306 describes, as an example of a recording device, a printer that records an image on a medium unwound from a roll body. The printer includes a first driving roller that contacts an outer circumferential surface of the roll body, a second driving roller that unwinds the medium from the roll body, and a sensor that detects sagging of the medium unwound from the roll body. The printer includes a first drive unit that drives the first driving roller, and a second drive unit that drives the second driving roller.

When the sensor detects sagging of the medium, the first drive unit is controlled based on a signal from the sensor. By controlling the first drive unit, tension applied to the medium is adjusted. In other words, in the printer, when tension applied to the medium is small, the tension applied to the medium is adjusted.

In such a recording device, a great tension may be applied to the medium. When a great tension is applied to the medium, there is a risk that transport accuracy of the medium may be affected. Thus, when tension applied to the medium is great, the tension applied to the medium also needs to be adjusted.

SUMMARY

A transport device for solving the problem described above includes a first driving roller configured to contact an outer circumferential surface of a roll body on which a medium is wound, and apply rotational torque to the roll body, a second driving roller configured to unwind the medium from the roll body, a first drive unit configured to drive the first driving roller, a second drive unit configured to drive the second driving roller, and a control unit configured to control the first drive unit and the second drive unit, where the control unit controls the first drive unit, based on a magnitude of a load current flowing in the second drive unit.

A recording device for solving the problem described above includes the transport device described above, and a recording unit configured to perform recording onto the medium.

DESCRIPTION OF EXEMPLARY EMBODIMENTS

One exemplary embodiment of a recording device including a transport device will be described below with reference to the accompanying drawings. The recording device is, for example, an ink jet-type printer that records an image such as characters and photographs on a medium such as a sheet by discharging ink, which is an example of a liquid.

Figure 1:
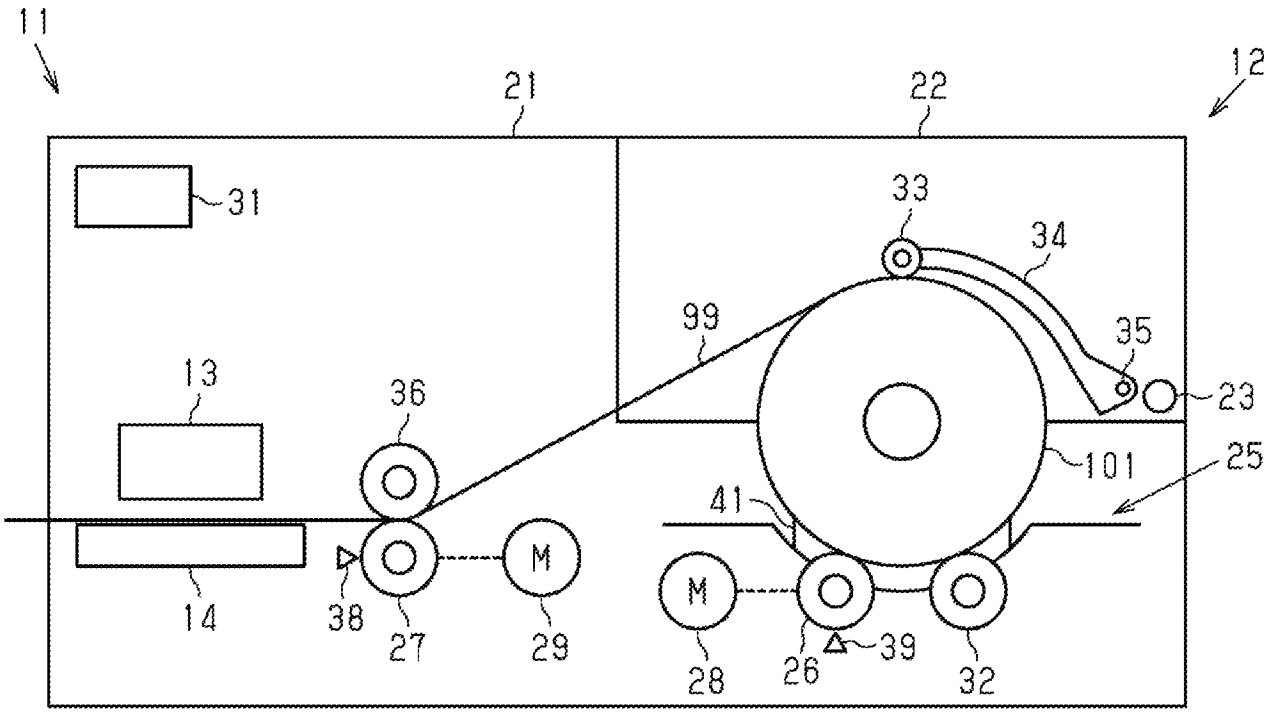
FIG. 1 is a side view schematically illustrating one exemplary embodiment of a recording device including a transport device.

As illustrated in FIG. 1, a recording device 11 includes a transport device 12 that transports a medium 99, and a recording unit 13 that performs recording onto the medium 99. The transport device 12 transports the medium 99 by unwinding the medium 99 from a roll body 101 on which the medium 99 is wound. The recording unit 13 performs recording onto the medium 99 transported by the transport device 12.

The recording device 11 in the present exemplary embodiment includes a support portion 14 that supports the medium 99 transported by the transport device 12. The support portion 14 is located in a position facing the recording unit 13. The recording unit 13 discharges a liquid onto the medium 99 at least in a region supported by the support portion 14.

Figure 2:
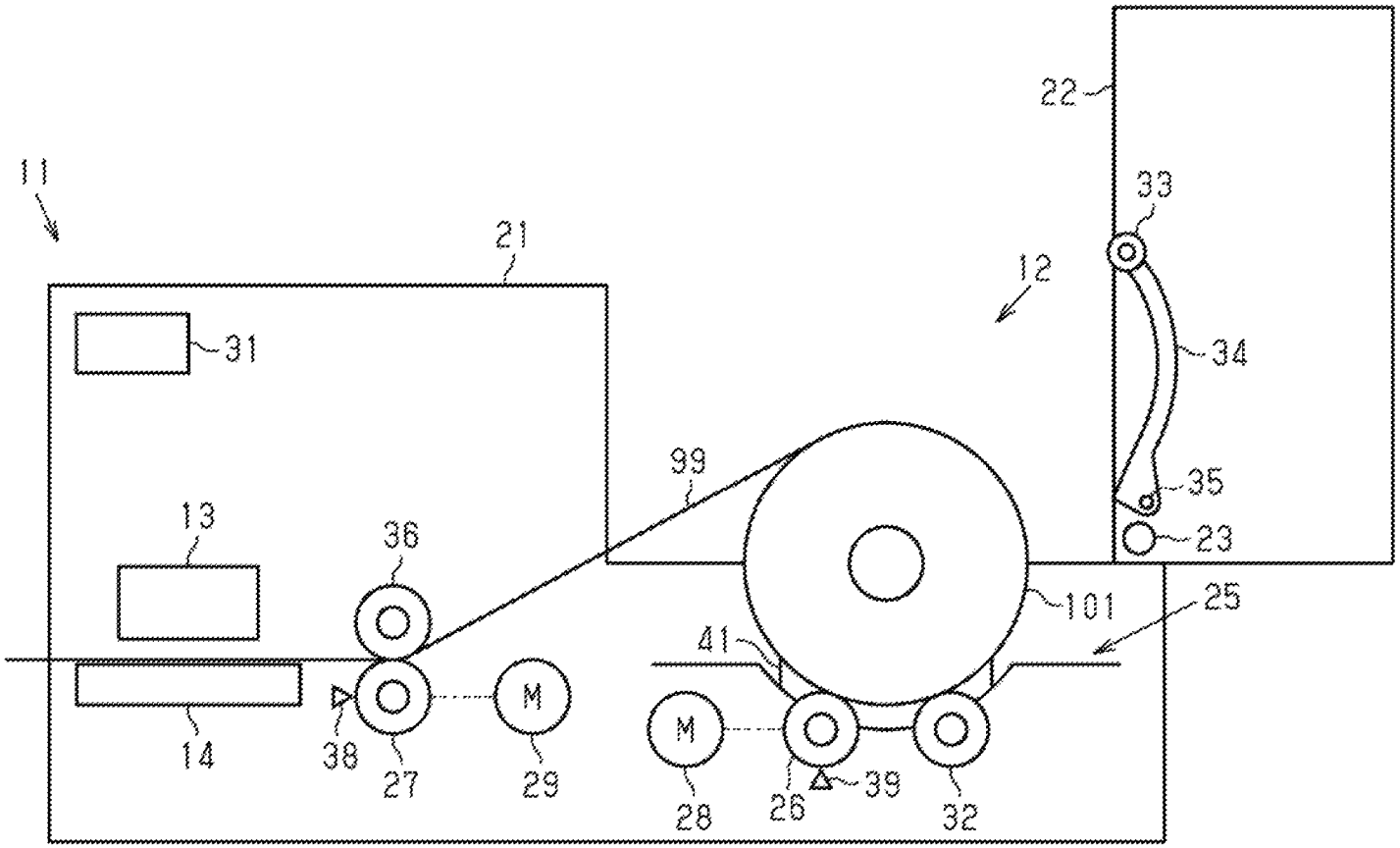
FIG. 2 is a side view when a cover is open.

As illustrated in FIGS. 1 and 2, the transport device 12 includes a housing 21, and a cover 22 that can be opened and closed with respect to the housing 21. The housing 21 in the present exemplary embodiment houses the recording unit 13 and the support portion 14. In FIG. 1, the cover 22 is closed. In FIG. 2, the cover 22 is open. When the cover 22 is opened, the roll body 101 can be set to the transport device 12. The cover 22 in the present exemplary embodiment is rotatable about a first shaft 23. The cover 22 is opened and closed with respect to the housing 21 by rotating about the first shaft 23.

The transport device 12 in the present exemplary embodiment includes a housing portion 25 that houses the roll body 101. The housing portion 25 is located inside the housing 21. When the cover 22 is opened, the housing portion 25 is exposed. The roll body 101 is set to the transport device 12 by being housed in the housing portion 25.

As illustrated in FIG. 1, the transport device 12 includes a first driving roller 26 that contacts an outer circumferential surface of the roll body 101 and applies rotational torque to the roll body 101. The transport device 12 includes a second driving roller 27 that unwinds the medium 99 from the roll body 101. The first driving roller 26 and the second driving roller 27 in the present exemplary embodiment are located inside the housing 21. The first driving roller 26 is provided in the housing portion 25, for example. The first driving roller 26 contacts the outer circumferential surface of the roll body 101 housed in the housing portion 25.

The first driving roller 26 contacts the outer circumferential surface of the roll body 101 so as not to slip with respect to the roll body 101. The first driving roller 26 can apply, to the roll body 101, rotational torque that rotates the roll body 101 in a direction of unwinding the medium 99. The first driving roller 26 can apply, to the roll body 101, rotational torque that rotates the roll body 101 in a direction of winding the medium 99.

The second driving roller 27 in the present exemplary embodiment transports the medium 99 from the roll body 101 toward the recording unit 13. When the second driving roller 27 rotates, the medium 99 is pulled from the roll body 101. When the medium 99 is pulled, the roll body 101 rotates. In this way, the medium 99 is unwound from the roll body 101. The second driving roller 27 rotates so as not to slip with respect to the medium 99.

In the present exemplary embodiment, the medium 99 is unwound by rotating the roll body 101 in a counterclockwise direction in FIG. 2. In other words, the counterclockwise direction in FIG. 1 is a direction of unwinding the medium 99. A clockwise direction in FIG. 1 is a direction of wounding the medium 99.

The transport device 12 includes a first drive unit 28 that drives the first driving roller 26, and a second drive unit 29 that drives the second driving roller 27. In other words, the first driving roller 26 is rotated by the first drive unit 28. The second driving roller 27 is rotated by the second drive unit 29. The first drive unit 28 and the second drive unit 29 include a motor, for example.

The transport device 12 includes a control unit 31 that controls the first drive unit 28 and the second drive unit 29. The control unit 31 controls rotation of the first driving roller 26 and rotation of the second driving roller 27 by controlling the first drive unit 28 and the second drive unit 29. The control unit 31 controls a transport speed and transport torque of the medium 99 by controlling the rotation of the second driving roller 27. The control unit 31 adjusts tension applied to the medium 99 by controlling the rotational torque of the first driving roller 26.

The control unit 31 in the present exemplary embodiment comprehensively controls the transport device 12. The control unit 31 is constituted by a CPU, memory, and the like, for example. The control unit 31 controls the transport device 12 by the CPU executing a program stored in the memory. The control unit 31 may control the recording unit 13.

The transport device 12 may include a first driven roller 32 that contacts the outer circumferential surface of the roll body 101 at a position different from that of the first driving roller 26 in an outer circumferential direction along the outer circumferential surface of the roll body 101. The first driven roller 32 rotates by following rotation of the roll body 101. The first driven roller 32 is provided in the housing portion 25, for example.

In the present exemplary embodiment, the first driving roller 26 and the first driven roller 32 support the roll body 101. Thus, the first driving roller 26 and the first driven roller 32 are each located in a position receiving a load of the roll body 101 housed in the housing portion 25. The first driving roller 26 and the first driven roller 32 are located below the roll body 101 housed in the housing portion 25.

The first driving roller 26 and the first driven roller 32 are located so as to sandwich a shaft center of the roll body 101 housed in the housing portion 25 in a horizontal direction. In this way, the roll body 101 is supported in a stable state by the first driving roller 26 and the first driven roller 32. The first driving roller 26 and the first driven roller 32 are each provided in a position contacting the outer circumferential surface of the roll body 101 even when a diameter of the roll body 101 decreases due to the medium 99 being unwound in the housing portion 25.

Instead of the first driven roller 32, the transport device 12 may include a contact portion that contacts the outer circumferential surface of the roll body 101 at a position different from that of the first driving roller 26 in the outer circumferential direction along the outer circumferential surface of the roll body 101. The contact portion is located in a position receiving a load of the roll body 101. The contact portion has a shape that does not inhibit the rotation of the roll body 101, and is formed of a material having a low coefficient of friction with respect to the roll body 101.

The transport device 12 may include a second driven roller 33 that presses the roll body 101 against the first driving roller 26 by contacting the outer circumferential surface of the roll body 101. The second driven roller 33 contacts the roll body 101 housed in the housing portion 25 from above, for example. The second driven roller 33 presses the roll body 101 downward. In this way, the roll body 101 comes into intimate contact with the first driving roller 26. As a result, the first driving roller 26 easily applies the rotational torque to the roll body 101. In the present exemplary embodiment, the roll body 101 comes into intimate contact with the first driving roller 26 and the first driven roller 32.

The transport device 12 in the present exemplary embodiment includes an arm 34 that rotatably supports the second driven roller 33. The arm 34 is attached to the cover 22 via a second shaft 35. The second driven roller 33 is attached to a tip of the arm 34. The second shaft 35 is provided at a proximal end of the arm 34 opposite to the tip.

The arm 34 is rotatable about the second shaft 35. The arm 34 is biased such that the second driven roller 33 approaches the shaft center of the roll body 101 housed in the housing portion 25 by the action of gravity. In this way, the second driven roller 33 is pressed against the roll body 101. As a result, the second driven roller 33 presses the roll body 101 against the first driving roller 26. The displacement of the second driven roller 33 causes the second driven roller 33 to press the roll body 101 against the first driving roller 26 even when a diameter of the roll body 101 decreases due to the medium 99 being unwound.

A torsion spring that rotates the arm 34 such that the second driven roller 33 approaches the roll body 101 housed in the housing portion 25 may be provided on the second shaft 35. In this way, the roll body 101 can be strongly pressed against the first driving roller 26.

The transport device 12 in the present exemplary embodiment includes a third driven roller 36. The third driven roller 36 is located in a position facing the second driving roller 27. When the second driving roller 27 is driven with the second driving roller 27 and the third driven roller 36 sandwiching the medium 99, the third driven roller 36 rotates by following the medium 99. In this way, the medium 99 is unwound from the roll body 101.

The second driving roller 27 is not limited to a configuration in which the second driving roller 27 is in direct contact with the medium 99, and may be configured to contact the medium 99 via a belt, for example. In this case, the medium 99 is unwound from the roll body 101 by a belt drive mechanism including the second driving roller 27. In this case, the medium 99 can be adsorbed to the belt by an adhesive, static electricity, and vacuum suction.

Further, the third driven roller 36 may be omitted. In this case, the second driving roller 27 can unwind the medium 99 from the roll body 101 by being driven with the medium 99 in the adsorbed state by an adhesive, static electricity, and the like.

The transport device 12 in the present exemplary embodiment includes a first detection unit 38 that detects the amount of rotation of the second driving roller 27. A current detection unit (not illustrated) detects a current value flowing through the second drive unit 29 with respect to the amount of rotation of the second driving roller 27 detected by the first detection unit 38, and thus a rotational load applied to the second driving roller 27 can be determined. The current detection unit (not illustrated) detects a load current flowing in the second drive unit 29, and is one of functions of the control unit 31. The transport device 12 may include a second detection unit 39 that detects the amount of rotation of the first driving roller 26. In this case, a rotational load applied to the first driving roller 26 can be determined. The first detection unit 38 and the second detection unit 39 include a rotary encoder, for example. Note that the current detection unit (not illustrated) may not be included in the control unit 31.

When the medium 99 is transported, the second driving roller 27 is driven. When the second driving roller 27 is driven, the medium 99 is unwound from the roll body 101. At this time, tension is applied to a portion of the medium 99 between the roll body 101 and the second driving roller 27. With the application of a predetermined magnitude of the tension to the portion of the medium 99 between the roll body 101 and the second driving roller 27, the medium 99 can be transported with high accuracy.

When the tension applied to the medium 99 is small, the medium 99 may sag between the roll body 101 and the second driving roller 27. When the medium 99 sags, the medium 99 may be transported in an obliquely tilted state. Thus, when the tension applied to the medium 99 is small, there is a risk that the transport accuracy of the medium 99 may decrease.

When the tension applied to the medium 99 is great, the medium 99 may slip with respect to the second driving roller 27. Thus, when the tension applied to the medium 99 is great, there is a risk that the transport accuracy of the medium 99 may decrease. Further, when the tension applied to the medium 99 is great, there is also a risk that damage of the medium 99 may be caused.

When the medium 99 is unwound from the roll body 101 by driving the second driving roller 27, a rotational load is applied, as a reaction of unwinding, to the second driving roller 27. In other words, when the tension applied to the medium 99 is great, the rotational load applied to the second driving roller 27 is great. When the tension applied to the medium 99 is small, the rotational load applied to the second driving roller 27 is small.

The second driving roller 27 is controlled so as to rotate at a predetermined rotational speed in order to transport the medium 99 at a predetermined speed. Thus, a load current flows to the second drive unit 29 in accordance with the rotational load applied to the second driving roller 27. When the rotational load applied to the second driving roller 27 is great, a great load current flows to the second drive unit 29. When the rotational load applied to the second driving roller 27 is small, a small load current flows to the second drive unit 29.

For example, when a weight of the roll body 101 is great, when a friction between the roll body 101 and the medium 99 is great, and the like, a great rotational load is applied to the second driving roller 27. In this case, a great load current flows to the second drive unit 29. Conversely, when a weight of the roll body 101 is small, when a friction between the roll body 101 and the medium 99 is small, and the like, a small rotational load is applied to the second driving roller 27. In this case, a small load current flows to the second drive unit 29.

The tension applied to the medium 99 is adjusted by applying the rotational torque to the roll body 101 by the first driving roller 26. In other words, when the first driving roller 26 applies, to the roll body 101, the rotational torque that rotates the roll body 101 in the direction of unwinding the medium 99, the tension applied to the medium 99 is reduced. When the first driving roller 26 applies, to the roll body 101, the rotational torque that rotates the roll body 101 in the direction of winding the medium 99, tension applied to the medium 99 increases. In this way, the tension applied to the medium 99 can be adjusted by controlling a direction and a magnitude of the rotational torque of the first driving roller 26.

The control unit 31 controls the first drive unit 28, based on a magnitude of a load current flowing in the second drive unit 29. In this way, the tension applied to the medium 99 can be adjusted in both cases in which the tension applied to the medium 99 is small and great. The control unit 31 in the present exemplary embodiment controls the first drive unit 28 such that a magnitude of the tension applied to the medium 99 is a predetermined magnitude. For example, the control unit 31 controls the first drive unit 28 such that the load current flowing in the second drive unit 29 has a predetermined magnitude, namely, a target value.

When the load current flowing in the second drive unit 29 is greater than the target value, the control unit 31 applies, to the roll body 101, the rotational torque that rotates the roll body 101 in the direction of unwinding the medium 99 by controlling the first drive unit 28. In this way, tension applied to the medium 99 decreases. As a result, the rotational load applied to the second driving roller 27 decreases, and the load current flowing in the second drive unit 29 decreases.

When the load current flowing in the second drive unit 29 is smaller than the target value, the control unit 31 applies, to the roll body 101, the rotational torque that rotates the roll body 101 in the direction of winding the medium 99 by controlling the first drive unit 28. In this way, tension applied to the medium 99 increases. As a result, the rotational load applied to the second driving roller 27 increases, and the load current flowing in the second drive unit 29 increases.

Figure 3:
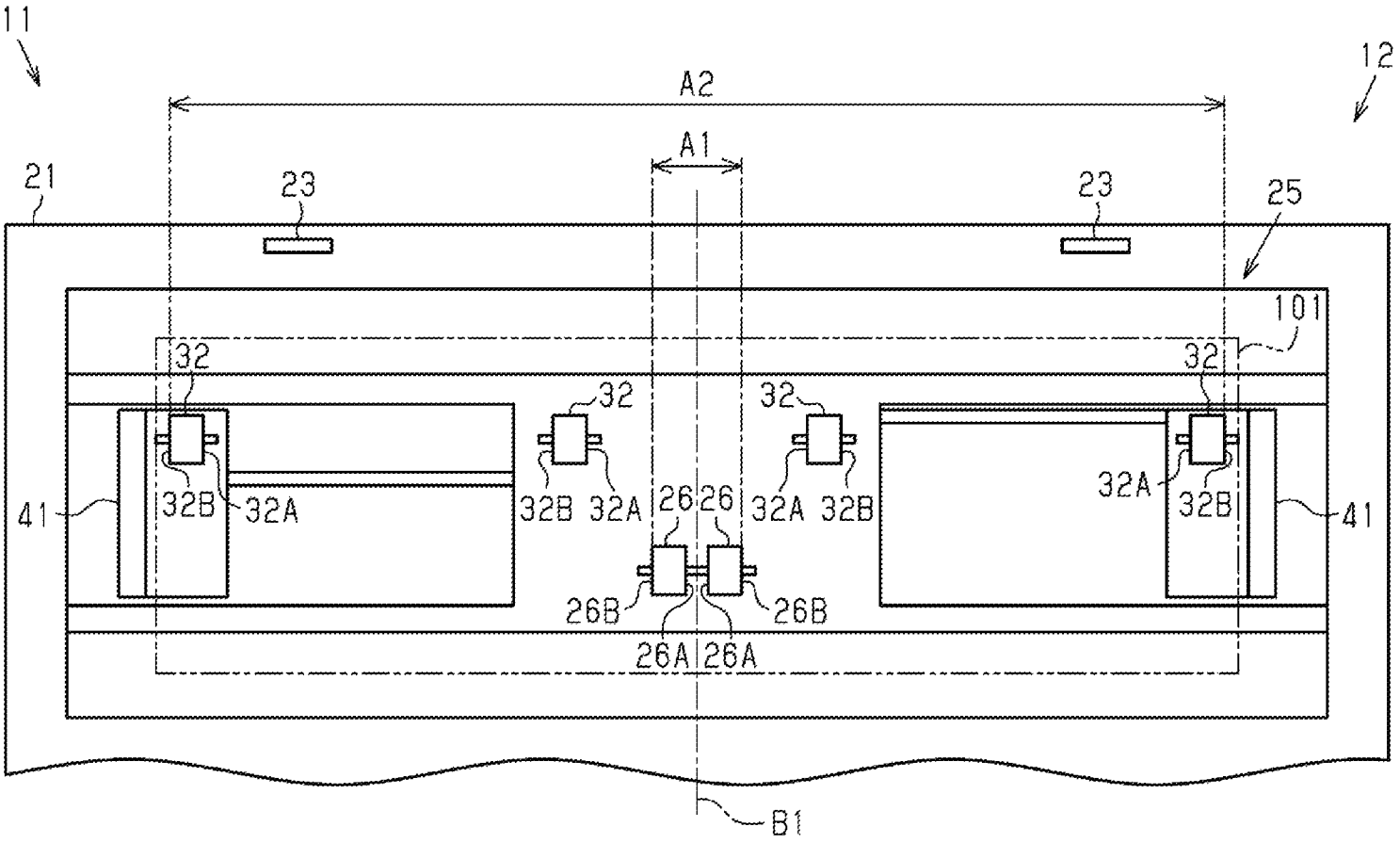
FIG. 3 is a top view of a housing portion.

In the present exemplary embodiment, as illustrated in FIG. 3, the first driving roller 26 and the first driven roller 32 are provided across a predetermined range in an axial direction thereof. The predetermined range in which the first driving roller 26 and the first driven roller 32 are provided is determined based on a maximum value of a length in an axial direction of the roll body 101. The axial direction of the first driving roller 26 is substantially parallel to the axial direction of the first driven roller 32. The axial direction of the first driving roller 26 and the axial direction of the first driven roller 32 are substantially parallel to the axial direction of the roll body 101 housed in the housing portion 25. In the present specification, the axial direction refers to two ways along a rotational axis thereof. A range in which the first driving roller 26 is provided in the axial direction is referred to as a first range A1, and a range in which the first driven roller 32 is provided in the axial direction is referred to as a second range A2.

A center in the axial direction of the first range A1 and a center in the axial direction of the second range A2 may be located so as to overlap each other in the axial direction. In this case, there is an axis passing through the center in the axial direction of the first range A1 and the center in the axial direction of the second range A2. This axis is referred to as a central axis B1. The central axis B1 extends in a direction different from the axial direction.

The first range A1 and the second range A2 are linearly symmetrical about the central axis B1. The center in the axial direction of the first range A1 and the center in the axial direction of the second range A2 are located so as to overlap each other in the axial direction, and thus a posture of the roll body 101 supported by the first driving roller 26 and the first driven roller 32 is easily stable.

The transport device 12 may include a plurality of first driving rollers 26. The plurality of first driving rollers 26 in the present exemplary embodiment include two first driving rollers 26 provided so as to be aligned in the axial direction in the housing portion 25. Of end portions of the first driving roller 26 in the axial direction, an end portion closer to the central axis B1 is referred to as an end portion 26A, and an end portion farther from the central axis B1 is referred to as an end portion 26B. In this case, a range from the end portion 26B of one of the two first driving rollers 26 to the end portion 26B of the other first driving roller 26 is the first range A1. The plurality of first driving rollers 26 may be arranged symmetrically with respect to the central axis B1 in the first range A1. Further, an interval between the plurality of first driving rollers 26 in the axial direction thereof may not be constant.

The transport device 12 may include a plurality of first driven rollers 32. In the present exemplary embodiment, the plurality of first driven rollers 32 include four first driven rollers 32 provided so as to be aligned in the axial direction thereof. Of end portions of the first driven roller 32 in the axial direction, an end portion closer to the central axis B1 is referred to as an end portion 32A, and an end portion farther from the central axis B1 is referred to as an end portion 32B. In this case, the second range A2 is defined by the two first driven rollers 32 located outside among the four first driven rollers 32. Specifically, a range from the end portion 32B of one of the two first driven rollers 32 located outside to the end portion 32B of the other first driven roller 32 is the second range A2. The plurality of first driven rollers 32 may be arranged symmetrically with respect to the central axis B1 in the second range A2. Further, an interval between the plurality of first driven rollers 32 in the axial direction thereof may not be constant.

In the axial direction, the first range A1 may be smaller than the second range A2. In this way, a load on the roll body 101 housed in the housing portion 25 is more likely to concentrate on the first driving roller 26 than the first driven roller 32. As a result, the roll body 101 easily comes into intimate contact with the first driving roller 26.

In the present exemplary embodiment, the two first driving rollers 26 are located between the two first driven rollers 32 located inside among the four first driven rollers 32 in the axial direction. The two first driving rollers 26 and the four first driven rollers 32 support the roll body 101. Thus, a contact area of the first driving roller 26 with respect to the outer circumferential surface of the roll body 101 is smaller than a contact area of the first driven roller 32 with respect to the outer circumferential surface of the roll body 101. In this way, a load on the roll body 101 easily concentrates on the first driving roller 26.

The transport device 12 may include a defining member 41 that defines a position of the roll body 101 housed in the housing portion 25. The defining member 41 is an edge guide, for example. The defining member 41 is provided in the housing portion 25, for example.

Two defining members 41 are provided at an interval therebetween in the axial direction. The two defining members 41 are located so as to be linearly symmetrical about the central axis B1. The defining members 41 define a position of the roll body 101 by contacting the roll body 101 so as to sandwich the roll body 101 housed in the housing portion 25.

The two defining members 41 are configured to operate in conjunction with each other. The two defining members 41 move so as to be linearly symmetrical about the central axis B1. In other words, when one of the defining members 41 moves closer to the central axis B1, the other defining member 41 moves closer to the central axis B1. The roll body 101 whose position is defined by the defining members 41 is located such that the center in the axial direction of the roll body 101 passes through the central axis B1. Thus, the roll body 101 is supported in a stable state.

In the present exemplary embodiment, the two first driven rollers 32 located outside among the four first driven rollers 32 are each attached to the defining member 41. Thus, when the defining member 41 moves, the attached first driven roller 32 also moves. When the two first driven rollers 32 located outside move, the size of the second range A2 in the axial direction changes. Even when the size of the second range A2 in the axial direction is minimized due to the movement of the defining members 41, the size of the second range A2 in the axial direction is greater than the size of the first range A1 in the axial direction. In other words, the size of the second range A2 changes, but a maximum value of the size of the second range A2 is determined based on a maximum value of a length in the axial direction of the roll body 101.

Next, the functions and effects of the exemplary embodiment described above will be described.

(1) The control unit 31 controls the first drive unit 28, based on a magnitude of a load current flowing in the second drive unit 29. When the medium 99 is unwound from the roll body 101 by driving the second driving roller 27, a load current flows to the second drive unit 29. The magnitude of a load current flowing in the second drive unit 29 and the magnitude of a tension applied to the medium 99 are correlated. In other words, when the load current flowing in the second drive unit 29 is great, the tension applied to the medium 99 is great. When the load current flowing in the second drive unit 29 is small, the tension applied to the medium 99 is small. Thus, according to the exemplary embodiment described above, tension applied to the medium 99 can be adjusted by controlling the first drive unit 28, based on a magnitude of a load current flowing in the second drive unit 29 in both cases in which the tension applied to the medium 99 is small and great.

(2) In the axial direction, the first range A1 is smaller than the second range A2. Thus, a load on the roll body 101 easily concentrates on the first driving roller 26. In this way, the roll body 101 easily comes into intimate contact with the first driving roller 26. Further, the center in the axial direction of the first range A1 and the center in the axial direction of the second range A2 are located so as to overlap each other in the axial direction. Thus, a posture of the roll body 101 supported by the first driving roller 26 and the first driven roller 32 is easily stable. In other words, according to the exemplary embodiment described above, the first driving roller 26 easily applies rotational torque to the roll body 101.

(3) The transport device 12 includes the second driven roller 33 that presses the roll body 101 toward the first driving roller 26 by contacting the outer circumferential surface of the roll body 101. In this way, the second driven roller 33 makes it easier for the roll body 101 to come into intimate contact with the first driving roller 26. In other words, the first driving roller 26 easily applies rotational torque to the roll body 101.

(4) The transport device 12 includes the housing portion 25 that houses the roll body 101, and the defining member 41 that defines a position of the roll body 101 housed in the housing portion 25. According to the exemplary embodiment described above, a position of the roll body 101 is defined by the defining member 41, and thus oblique tilting of a posture of the medium 99 unwound from the roll body 101 can be suppressed. When a posture of the medium 99 is tilted obliquely, there is a risk that tension applied to the medium 99 may become uneven in the axial direction. Specifically, when a posture of the roll body 101 is tilted obliquely with the medium 99 sandwiched between the second driving roller 27 and the third driven roller 36, one side of the medium 99 in the axial direction sags and the other side of the medium 99 in the axial direction is in a state of being pulled. In this way, the tension applied to the medium 99 becomes uneven in the axial direction. When the tension applied to the medium 99 becomes uneven in the axial direction, a detection value of a load current flowing in the second drive unit 29 also becomes uneven in a width direction, and detection accuracy of the tension applied to the medium 99 decreases. In contrast, the load current flowing in the second drive unit 29 can be detected with high accuracy by defining a position of the roll body 101. In this way, the tension applied to the medium 99 can be adjusted with high accuracy.

The present exemplary embodiment described above may be modified as follows. The present exemplary embodiment and modified examples thereof to be described below may be implemented in combination within a range in which a technical contradiction does not arise.

The roll body 101 set to the transport device 12 may be supported by a spindle inserted into the roll body 101. In this case, since the first driving roller 26 does not need to support the roll body 101, a degree of freedom in a position in which the first driving roller 26 is provided can be increased. In this case, the rotational torque in the direction of unwinding the roll body 101 or the rotational torque in the direction of winding the roll body 101 is applied to the roll body 101 via the spindle. Specifically, a spindle gear is provided on one end of the spindle in the axial direction, and the roll body 101 is housed in the housing portion 25 in a state where the spindle is attached to the roll body 101. At this time, the first drive unit 28 is provided with a drive unit-side gear that engages with the spindle gear. When the roll body 101 is housed in the housing portion 25, the spindle gear engages with the drive unit-side gear and transmits the rotational torque from the first drive unit 28 to the shaft center of the roll body 101 via the drive unit-side gear and the spindle gear. Even such a configuration can adjust the tension applied to the medium 99.

The first driving roller 26 may be provided other than in the housing portion 25. For example, the first driving roller 26 may be provided on the cover 22.

The first driven roller 32 may be provided other than in the housing portion 25. For example, the first driven roller 32 may be provided on the cover 22.

The first driving roller 26 may be an elongated roller provided across the central axis B1.

The first driven roller 32 may be an elongated roller provided across the central axis B1.

The medium 99 is not limited to paper, and may be a fabric or a plastic film.

The recording device 11 is not limited to an ink jet method, and may be configured to record an image in an electronic photo method, for example.

The recording unit 13 may be a thermal head that performs recording by applying heat to the medium 99.

The liquid discharged by the recording unit 13 is not limited to ink, and may be, for example, a liquid material including particles of a functional material dispersed or mixed in liquid. For example, the recording unit 13 may discharge a liquid material including a material such as an electrode material or a pixel material used in manufacture of a liquid crystal display, an electroluminescent (EL) display, and a surface emitting display in a dispersed or dissolved form.

Hereinafter, technical concepts and effects thereof that are understood from the above-described exemplary embodiments and modified examples will be described.

A transport device includes a first driving roller configured to contact an outer circumferential surface of a roll body on which a medium is wound, and apply rotational torque to the roll body, a second driving roller configured to unwind the medium from the roll body, a first drive unit configured to drive the first driving roller, a second drive unit configured to drive the second driving roller, and a control unit configured to control the first drive unit and the second drive unit. The control unit controls the first drive unit, based on a magnitude of a load current flowing in the second drive unit.

When the medium is unwound from the roll body by driving the second driving roller, a load current flows to the second drive unit. The magnitude of a load current flowing in the second drive unit and the magnitude of a tension applied to the medium are correlated. In other words, when the load current flowing in the second drive unit is great, the tension applied to the medium is great. When the load current flowing in the second drive unit is small, the tension applied to the medium is small. Thus, according to the configuration described above, tension applied to the medium can be adjusted by controlling the first drive unit, based on a magnitude of a load current flowing in the second drive unit in both cases in which the tension applied to the medium is small and great.

The transport device described above may include a first driven roller configured to contact the outer circumferential surface of the roll body at a position different from that of the first driving roller in an outer circumferential direction along the outer circumferential surface of the roll body. The first driving roller and the first driven roller may support the roll body. In axial directions of the first driving roller and the first driven roller, a range in which the first driving roller is provided may be smaller than a range in which the first driven roller is provided. A center in the axial direction of the range in which the first driving roller is provided and a center in the axial direction of the range in which the first driven roller is provided may be located overlapping each other in the axial direction.

In the axial directions of the first driving roller and the first driven roller, the range in which the first driving roller is provided is smaller than the range in which the first driven roller is provided. Thus, a load on the roll body easily concentrates on the first driving roller. In this way, the roll body easily comes into intimate contact with the first driving roller. Further, the center in the axial direction of the range in which the first driving roller is provided and the center in the axial direction of the range in which the first driven roller is provided are located so as to overlap each other in the axial direction. Thus, a posture of the roll body supported by the first driving roller and the first driven roller is easily stable. In other words, according to the configuration described above, the first driving roller easily applies rotational torque to the roll body.

The transport device may include a second driven roller configured to press the roll body against the first driving roller by contacting the outer circumferential surface of the roll body.

According to this configuration, the second driven roller makes it easier for the roll body to come into intimate contact with the first driving roller. In other words, the first driving roller easily applies the rotational torque to the roll body.

The transport device may include a housing portion configured to house the roll body, and a defining member configured to define a position of the roll body housed in the housing portion.

According to this configuration, a position of the roll body is defined by the defining member, and thus oblique tilting of a posture of the medium unwound from the roll body can be suppressed. When a posture of the medium is tilted obliquely, there is a risk that tension applied to the medium may become uneven. Thus, a load current flowing in the second drive unit can be detected with high accuracy by defining a position of the roll body. In this way, the tension applied to the medium can be adjusted with high accuracy.

A recording device includes the transport device described above, and a recording unit configured to perform recording onto the medium.

According to this configuration, an effect similar to that of the transport device described above can be obtained.

What is claimed is:

1. A transport device, comprising:

a plurality of first driving rollers configured to contact an outer circumferential surface of a roll body on which a medium is wound, and apply rotational torque to the roll body;

a second driving roller configured to unwind the medium from the roll body;

a first drive unit configured to drive the plurality of first driving rollers;

a second drive unit configured to drive the second driving roller;

a control unit configured to control the first drive unit and the second drive unit; and a plurality of first driven rollers configured to contact the outer circumferential surface of the roll body at a position different from that of the plurality of first driving rollers in an outer circumferential direction along the outer circumferential surface of the roll body, wherein the control unit controls the first drive unit, based on a magnitude of a load current flowing in the second drive unit, a number of the plurality of first driving rollers is smaller than a number of the first driven rollers, and the plurality of the first driving rollers and the plurality of the first driven rollers do not overlap in an axial direction of the first driving rollers or an axial direction of the first driven rollers.

2. The transport device according to claim 1, wherein:

a center of a first range, in which the plurality of first driving rollers are provided, overlaps a center of a second range, in which the plurality of first driven rollers are provided, in an axial direction of the first driving rollers or an axial direction of the first driven rollers.

3. The transport device according to claim 1, comprising a second driven roller configured to press the roll body against the first driving roller by contacting the outer circumferential surface of the roll body.

4. The transport device according to claim 1, comprising:

a housing portion configured to house the roll body; and a defining member configured to define a position of the roll body housed in the housing portion.

5. A recording device, comprising:

the transport device according to claim 1; and a recording unit configured to perform recording onto the medium.

6. The transport device according to claim 1, wherein:

the plurality of first driving rollers are positioned between a first end portion and a second end portion of an innermost pair of the first driven rollers that face each other in the axial direction of the first driven rollers.

* * * * *